US005533364A

United States Patent [19]

Freilich

[11] Patent Number: 5,533,364

[45] Date of Patent: Jul. 9, 1996

[54] FACING MARQUIS HALVES TO FORM A MARQUIS STONE

[75] Inventor: Joseph Freilich, Jericho, N.Y.

[73] Assignee: M. Fabrikant & Sons, Ltd., New York, N.Y.

[21] Appl. No.: 320,005

[22] Filed: Oct. 7, 1994

Related U.S. Application Data

[63] Continuation-in-part of Ser. No. 163,941, Dec. 8, 1993, abandoned.

[51] Int. Cl.[6] ..... A44C 17/00

[52] U.S. Cl. ..... 63/32; 63/28

[58] Field of Search ..... 63/32, 28, 26

[56] References Cited

U.S. PATENT DOCUMENTS 3,394,692 7/1968 Sirakian .
5,072,601 12/1991 Slowinski ..... 63/32
5,123,265 6/1992 Ramot ..... 63/28

FOREIGN PATENT DOCUMENTS 359826 11/1905 France ..... 63/32
1015310 12/1965 United Kingdom ..... 63/32

*Primary Examiner*—Flemming Saether
*Attorney, Agent, or Firm*—Levisohn, Lerner, Berger & Langsam

[57] ABSTRACT

A gem for a piece of jewelry is made from smaller gems set by prong settings to provide abutting facets of each in which the line of abutment is substantially invisible to the ordinary observer. The facing facets are angled with respect to an imaginary plane therebetween.

6 Claims, 3 Drawing Sheets

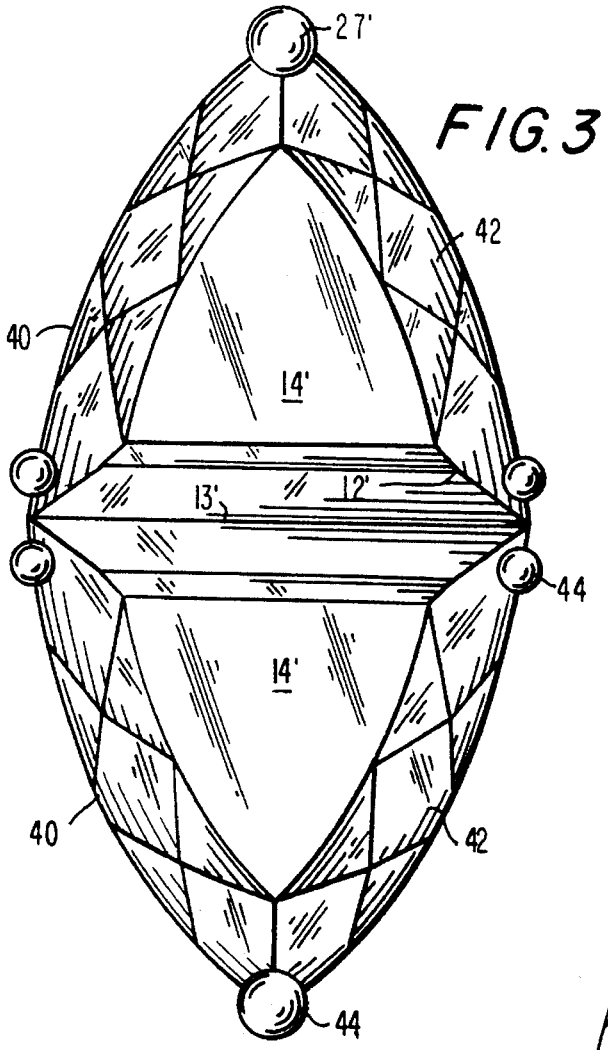
FIG. 3
FIG. 4
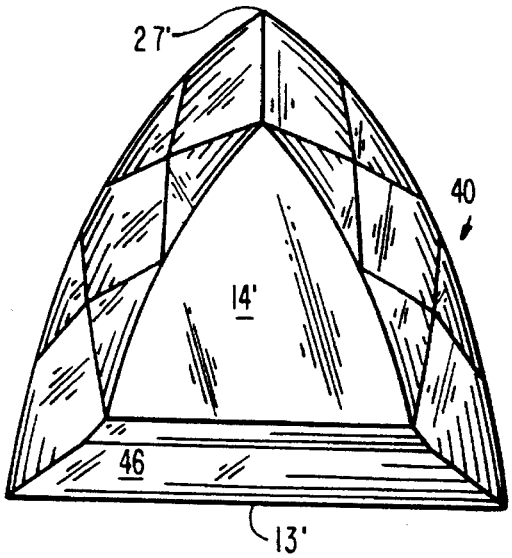
FIG. 5
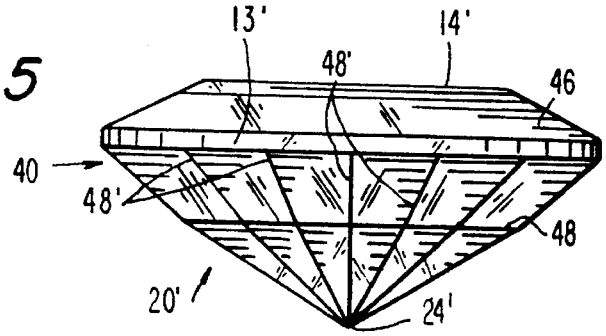

FACING MARQUIS HALVES TO FORM A MARQUIS STONE

REFERENCE TO RELATED APPLICATIONS:

This application is a continuation-in-part application of U.S. Ser. No. 08/163,941 entitled GEM COMPOSITE FOR A SIMULATED JEWEL, filed Dec. 8, 1993, now abandoned.

BACKGROUND OF THE INVENTION

1. Field of the Invention

The present invention relates to Jewelry, more specifically to jewelry having a large gem which is simulated by juxtaposition of smaller gems.

2. Description of the Prior Art

In a piece of jewelry, the apparent size of a gem contributes greatly to the beholder's perception of beauty and value of the piece.

Many of the most favored gemstones for jewelry are not available in impressively large sizes unless they are manufactured artificially. Purchasers, however, prefer natural, mined, gemstones.

One way to obtain a large gem by using smaller gems is to join two smaller gems of the same type of gemstone, at a pair of facet faces which are matched in shape and size, one from each gemstone. The remaining portion of the joined gems which is visible in the jewelry setting is physically made in the shape of a solid, larger, unitary gem.

This requires expensive matching of the shape, color, and alignment of the joined facets which are held in place by prong setting. Nevertheless, when the two gems are so joined, the ordinary observer sees that they are two, discrete, gems joined together, rather than seeing them as a unitary or continuous gem.

U.S. Pat. No. 3,394,692 entitled "CUTTING AND ASSEMBLY OF PRECIOUS STONES" issued on Jul. 30, 1968 to jean Sirakian identified a method of cutting and assembling matching smaller stones to form a larger marquise or navette. The Sirakian method specifically teaches that the base pavilion is prepared without additional faceting such that base pavilion 20 of each stone of the Sirakian patent is a continuous surface as illustrated both in FIGS. 2 and 3. In order to reduce the visibility of the joint between the stones, Sirakian states in col. 3 that the base pavilion has the single facet illustrated in FIG. 3 and that the cullett 24 is positioned at about 9/10 of the length of the stone. Sirakian specifically suggests in col. 3 that a conventional cut would have the cullett at about 6/10 of the length of the stone.

The present invention specifically improves upon the Sirakian teaching by providing additional faceting for the base pavilion surface and by locating the cullett at about 6/10 of the length of the stone which provides an enhanced resulting combination eliminating the dark zone in the assembled stone and providing optimal light reflection. By providing the combination of the additional faceting for the base pavilion and moving the cullett to approximately 6/10 the length of the stone, a reduction in the weight of each stone is achieved which results in reduced costs while the elimination of the dark zone in the region of the edges of the matching stones is also eliminated. While the inventor has not determined whether or not the elimination of the dark zone in Sirakian is as complete as that in the present invention, the inventor has determined that by additionally faceting the base pavilion surface, a reduction in stone size is achieved in the matching stones because the cullett can be moved more to the center of the stone than is taught in Sirakian.

It is one object of the present invention to provide jewelry with a gem made from gems, that is larger to the perception of the observer than the size of the individual gems from which it is made.

It is another object that the gem made from smaller gems presents to an ordinary observer a unitary, continuous gem that is larger than either of the gems from which it is made.

It is another object that the layer gem made from the smaller gems requires smaller gems of lower weight than previously required.

In accordance with the teachings of this invention, a marquise or navette is formed of two matching half marquise stones as viewed from the top which abut along a joining edge. The base pavilion surface of each stone has a second facet which abuts and angles from the first facet. The cullett is at approximately 6/10 the length of each half marquise stone.

Preferably the two stones are mirror images of one another when viewed directly down a bisecting ray of the angle of the divergence originating from the abutment of the facets.

BRIEF DESCRIPTION OF THE DRAWINGS

In order that the invention be more fully comprehended, it will now be described, by way of example, with reference to the accompanying drawings, in which:

FIG. 3 is a top view of the assembled stones of the present invention.

FIG. 4 is a top view of one of the stones of FIG. 3.

FIG. 5 is a front view of one of the stones shown in FIG. 3.

DESCRIPTION OF THE PREFERRED EMBODIMENTS

Figure 1:
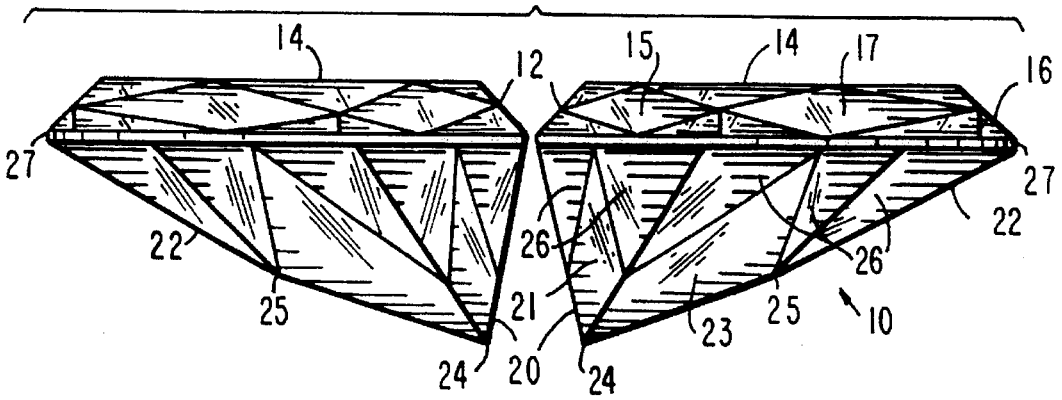
FIG. 1 PRIOR ART
FIGS. 1 and 2 are side elevations and bottom views of the two assembled stones of the Sirakian prior art patent 3,394,692.
Figure 2:
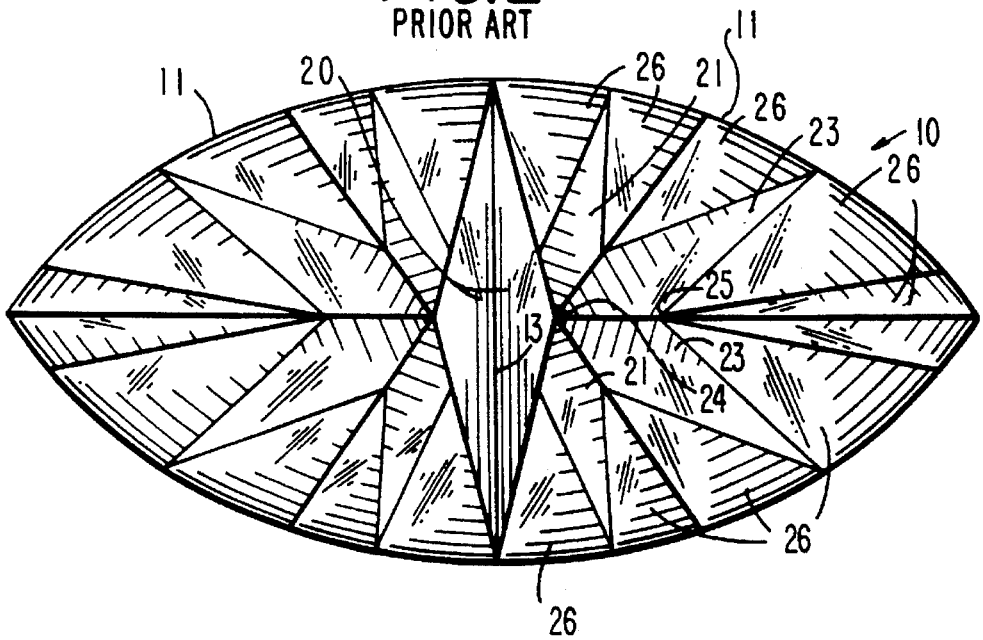
FIG. 2 PRIOR ART

FIGS. 1 and 2 are taken from FIGS. 2 and 3 and are substantially identical to such figures as presented in U.S. Pat. No. 3,394,692 to Sirakian. These figures conform to the description in the specification in which two stones are assembled into a marquise or navette with facing bezels 12 and base pavilions 20 which allow the stones to be joined edge to edge which, allegedly in the Sirakian disclosure eliminates dark zones along the joined axis 13. As specifically taught in the Sirakian disclosure, base pavilions 20 contain a single cut to present a continuous surface from edge 13 to cullett 24. Cullett 24 is located approximately 9/10 the length of the stone as illustrated in FIG. 1. The length of the stone 14 is taken to be that distance between edge 13 and the point between end facets 18, generally shown with numeral 27 in FIG. 2. Cullett 24 is 9/10 the way toward edge 13 from end point 27.

The present invention represents an improvement over the Sirakian teaching in that less weight is required for each of the smaller stones in order to achieve the improved and enhanced appearance in which the dark zone is eliminated along the abutting edge 13' as illustrated in FIG. 3.

For purposes of reference herein, the reference numerals identified in FIGS. 1 and 2 of the prior art are identical to the reference numerals utilized in prior U.S. Pat. No. 3,394,692 which is incorporated herein by reference. Generally, the important aspects of the prior art figures relates to the base pavilion 20, the juncture line 13, the cullett apex 24, while the remaining numerals generally relate either to the stone or to the faceting as identified in the prior patent.

Where possible, similar numerals will be utilized in describing the present invention with prime numerals added as appropriate.

Figure 6:
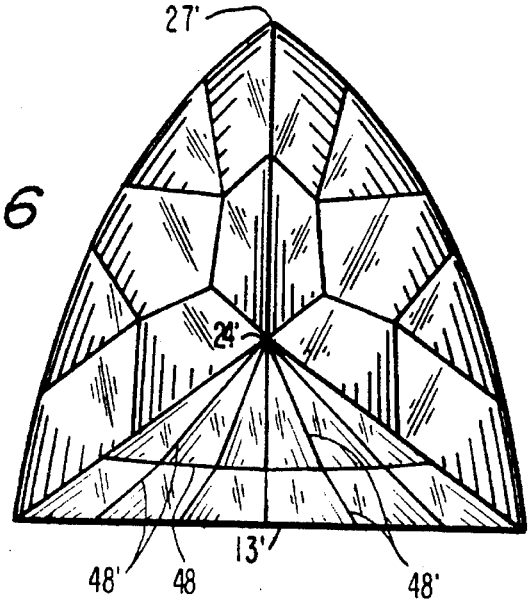
FIG. 6 is a bottom plan or pavilion view of one of the stones of FIG. 3.
Figure 7:
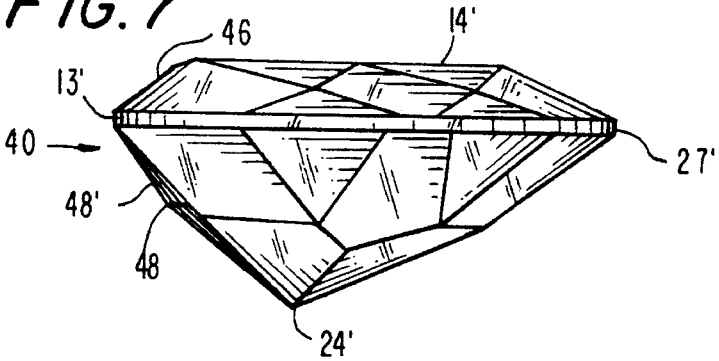
FIG. 7 is a side elevation view of one of the stones of FIG. 3.

Generally, the two stones of the present invention are half marquise stones, as shown in FIG. 3 which is a top plan view showing the stones 40, generally being identical, having tables 14', faceted side bezels 42 with prongs 44 holding the stones in place. Juncture 13' is formed between matching edges 41 of the stones 40 and facing base bezels 12' are illustrated with multiple facets running horizontally as shown in FIG. 5 by reference numeral 46. FIGS. 5 and 6 illustrate the multiple faceting for base pavilion surface 20' with a horizontal facet line 48 extending across the front of base pavilion 20'. FIG. 5 illustrates the front view, with the front being that portion of the half marquis stone which faces the other half marquis stone, so that the fronts of each of the stones face each other. The boundaries for the facets in the base pavilion surface 20' are comprised of horizontal facet line 48 and a plurality of upwardly directed facet lines 48' radiating upwardly from cullett 24' as illustrated in FIG. 5. The relationship of angles of the facets with the facing pavilion portions of the base pavilions are those that would be expected by one of ordinary skill in the art in forming such facets on such facing pavilion portions. There is no criticality to the relative angles of the facets except that one of ordinary skill in the art would create facets at expected angles at the location so identified. As shown in a side view FIG. 7 of the stone 40 of this invention, cullett apex 24 is located at approximately 6/10 the length of the stone taken from the juncture line 13 to tip or end point 27' of the girdle of the stone.

Figure 8:
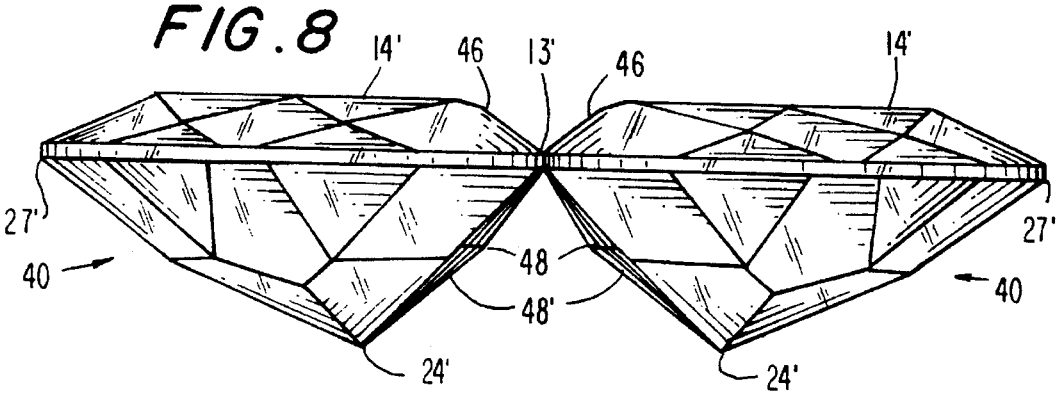
FIG. 8 is a side elevation view of the two stones of FIG. 3.

By comparing FIG. 1 of the prior art to FIG. 8 showing the corresponding side view of the present invention and FIG. 2 illustrating the prior art with FIG. 6 illustrating the present invention, it can be seen that cullett apex 24' is located closer to the center of each of the smaller stones and base pavilion 20' is a complex surface having multiple facets as contrasted with the unitary single facet of cullett stone 20 as illustrated in FIG. 2 above.

By providing the multiple faceted surface for the base pavilion 20' of the present invention, a lighter stone can be utilized, while an enhanced and improved resulting marquise or navette can be formed with the dark zone between the mating faces eliminated as found in the present invention.

As stated above, while the Sirakian prior patent suggests that the dark zones are eliminated, the present applicants have not constructed a stone nor are they familiar with a stone such as described by Sirakian, so that no comparison can be made of the elimination of the dark zone, although the present applicant has substantially eliminated the dark zone in the assembled stones because the present invention optimally reflects light in the junction region to eliminate such dark zones.

The overall effect of the present invention is to provide an improved apparatus and method to assemble two stones into a marquise or navette so as to provide a larger resulting stone without the dark zones apparent in most prior art, yet as compared to the Sirakian disclosure, utilizing less stone weight to achieve a similar if not better visual appearance.

Preferably, the joined gems are of the same type, and have the same quality of color. They need not be precisely matched in shape of facet or in cut in order to obtain a presentation of a continuous, unitary, larger gem.

Gems suited for use in the present invention include Tanzanite, Diamond Tanzanite, Tsavorite, Sapphire, Ruby, Emerald, Beryl, and Topaz.

Although the invention has been described in terms of specific preferred embodiments, it will be obvious to one skilled in the art that various modifications and substitutions are contemplated by the invention disclosed herein and that all such modifications and substitutions are included within the scope of the invention as defined in the appended claims.

I claim:

1. A marquis appearing jewelry stone assembly which employs a pair of facing jewelry stones to produce a marquis appearing jewelry stone larger than either of the facing jewelry stones, said assembly comprising:

one of said pair of facing jewelry stones comprising a first half marquis jewelry stone having a matching edge at one end and an end point at an opposite end of said facing jewelry stones, the other of said pair of facing jewelry stones comprising a second half marquis stone having a matching edge at one end and an end point at an opposite end of said facing jewelry stones, each of said first and second half marquis stones comprising facing bezels and base pavilions, said facing bezel of said first half marquis stone facing said facing bezel of said second half marquis stone, said base pavilion of said first half marquis stone facing said base pavilion of said second half marquis stone, said first and second half marquis stones abutting each other along said matching edges to form a junction between said first and second half marquis stones, each of said base pavilions comprising a multi-faceted surface, wherein each of said first and second half marquis jewelry stones comprise a cullett apex, each of said half marquis stones having a length defined as the distance between said matching edge and said end point, said cullett apex located approximately 6/10– 7/10 of said length of the stone towards said matching edge from said end point.

2. The invention described in claim 1 wherein said pair of facing jewelry stones are of the same type of gemstone.

3. The invention described in claim 1, wherein said first jewlery stone is selected from the group of gemstones consisting of Tanzanite Diamond, Tsavorite, Sapphire, Ruby, Emerald, Beryl, and Topaz.

4. The invention described in claim 3, wherein said base bezels of said first and second half marquise stones are mirror images of one another.

5. The invention described in claim 4, wherein said base pavilions of said first and second half marquise stones are mirror images of one another.

6. The invention described in claim 1, wherein said first and second half marquise stones are substantially identical in shape and material.

* * * * *